US010440791B2

(12) United States Patent
Szeto

(10) Patent No.: US 10,440,791 B2
(45) Date of Patent: Oct. 8, 2019

(54) LAMP, LIGHTING SYSTEM AND OPERATING METHOD FOR LIGHTING SYSTEM

(71) Applicant: Traxon Technologies Ltd., Hong Kong (HK)

(72) Inventor: Yan Hau Szeto, Shatin (HK)

(73) Assignee: TRAXON TECHNOLOGIES LTD., Shatin (HK)

( * ) Notice: Subject to any disclaimer, the term of this patent is extended or adjusted under 35 U.S.C. 154(b) by 0 days.

(21) Appl. No.: 16/081,820

(22) PCT Filed: Jun. 17, 2016

(86) PCT No.: PCT/CN2016/086147

§ 371 (c)(1),
(2) Date: Aug. 31, 2018

(87) PCT Pub. No.: WO2017/152537

PCT Pub. Date: Sep. 14, 2017

(65) Prior Publication Data

US 2019/0098718 A1 Mar. 28, 2019

(30) Foreign Application Priority Data

Mar. 11, 2016 (DE) ..... 10 2016 104 445

(51) Int. Cl.

| | |
|---|---|
| ***H05B 33/08*** | (2006.01) |
| ***H05B 37/02*** | (2006.01) |
| ***F21S 4/24*** | (2016.01) |

(52) U.S. Cl.

CPC ..... *H05B 33/0854* (2013.01); *F21S 4/24* (2016.01); *H05B 33/083* (2013.01); *H05B 33/0842* (2013.01); *H05B 33/0884* (2013.01); *H05B 37/0245* (2013.01); *H05B 37/0254* (2013.01)

(58) Field of Classification Search

CPC ..... H05B 33/0854; H05B 33/0884; H05B 33/083; H05B 37/0254; F21S 4/24

USPC ..... 315/185 R

See application file for complete search history.

(56) References Cited

U.S. PATENT DOCUMENTS

| | | | | |
|---|---|---|---|---|
| 2003/0057886 | A1 | 3/2003 | Lys et al. | |
| 2007/0222399 | A1* | 9/2007 | Bondy | F21S 2/00 315/291 |
| 2012/0280637 | A1* | 11/2012 | Tikkanen | H05B 33/0803 315/294 |

(Continued)

FOREIGN PATENT DOCUMENTS

| | | |
|---|---|---|
| CN | 101210665 | 7/2008 |
| CN | 103503560 A | 1/2014 |

(Continued)

*Primary Examiner* — Don P Le

(74) *Attorney, Agent, or Firm* — McDermott Will & Emery LLP

(57) ABSTRACT

The lamp (2) contains a plurality of semiconductor light sources (21) as well as an electrical terminal node (22) and at least one electrical connection line (23). Said semiconductor light sources (21) are electrically connected with the terminal node (22) via the connection line (23). Electrical operating data of the semiconductor light sources (21) are saved in the terminal node (22). The semiconductor light sources (21) can be electrically activated independently of each other. In addition, the terminal node (22) is an electrically passive or active component.

17 Claims, 2 Drawing Sheets

(56) References Cited

U.S. PATENT DOCUMENTS

Figure 1:
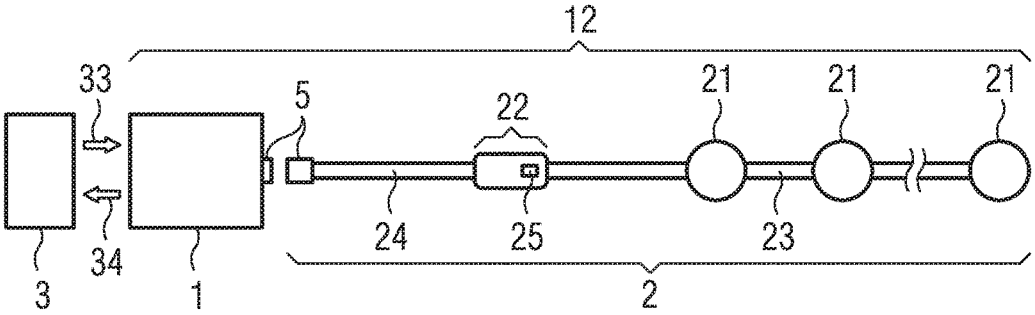

| | | | | |
|---|---|---|---|---|
| 2013/0249417 | A1 | 9/2013 | Verlinden | |
| 2014/0103819 | A1 * | 4/2014 | Mohan | H05B 37/0254 315/159 |

FOREIGN PATENT DOCUMENTS

| | | | |
|---|---|---|---|
| CN | 103843460 | A | 6/2014 |
| CN | 105191496 | A | 12/2015 |
| DE | 102011103907 | A1 | 8/2012 |

* cited by examiner

LAMP, LIGHTING SYSTEM AND OPERATING METHOD FOR LIGHTING SYSTEM

A lamp is provided. Furthermore, a lighting system and an operating method to this end are provided.

An object to be achieved by the invention is to provide a lamp, which can be efficiently integrated and operated in a lighting system.

Said object is achieved, inter alia, by a lamp and by a lighting system with the features of the independent claims. Preferred further developments are the subject matter of the remaining claims.

According to at least one embodiment, the lamp comprises a plurality of semiconductor light sources or groups of semiconductor light sources. The semiconductor light sources concerned are preferably light-emitting diodes (LEDs), or laser diodes. In particular all semiconductor light sources are formed by light-emitting diodes.

According to at least one embodiment, the lamp has one or more electrical terminal nodes. The semiconductor light sources or groups of semiconductor light sources are electrically connected with the terminal node. The lamp is set up in such a way as to be electrically contacted externally via the terminal node.

According to at least one embodiment, the lamp contains one or more electrical connection lines. The at least one electrical connection line is preferably a cable, in particular a multicore cable. The connection line may alternatively also be realized wireless.

According to at least one embodiment, the semiconductor light sources or groups of semiconductor light sources are electrically connected with the terminal node via the at least one connection line. In particular an electrical connection of the semiconductor light sources or of the groups outside the lamp ensues exclusively via the terminal node. The semiconductor light sources or the groups are preferably permanently connected with the terminal node via the connection line, such that such components do not become detached from each other when the lamp is used for its intended purpose.

According to at least one embodiment, electrical operating data of the semiconductor light sources or groups are stored in the terminal node. Said electrical operating data are, for example, saved in tabular form, as so-called look-up tables, for instance. The operating data preferably include characteristics of the semiconductor light sources, and therefore a correlation between an electricity to be fed in and a light to be emitted by the semiconductor light sources is saved by the operating data. Alternatively or additionally, the operating data comprise the information on which types of semiconductor light sources or groups are concerned, which types of semiconductor light sources or groups are present and how many semiconductor light sources or groups exist in combination with each other in the lamp and/or in which colour category, also as bins, the individual semiconductor light sources belong.

According to at least one embodiment, the semiconductor light sources or the groups of semiconductor light sources can be electrically activated independently of each other. For example, image points or image areas in a displayable image or lighting scenario are realized by the semiconductor light sources or by the groups. In particular the semiconductor light sources or the groups can be activated time-dependently with a variable emission colour and/or emission intensity.

According to at least one embodiment, the terminal node is an electrically passive component. "Electrically passive" means, for instance that no control signals go out to the semiconductor light sources or groups and/or that the terminal node does not process or prepare or relay any incoming signals and/or that the terminal node itself does not generate or record any operating data.

According to at least one embodiment, the terminal node is an electrically active component, such as a microprocessor or an integrated circuit. In such case the terminal node generates or processes in particular control signals for the semiconductor light sources or prepares such control signals.

In at least one embodiment, the lamp contains a plurality of semiconductor light sources or groups of semiconductor light sources as well as an electrical terminal node and at least one electrical connection line. The semiconductor light sources are electrically connected with the terminal node via the at least one connection line. Electrical operating data of the semiconductor light sources or of the groups of semiconductor light sources are stored in the terminal node.

The semiconductor light sources or groups of semiconductor light sources can be electrically activated independently of each other. In addition, the terminal node is an electrically active or passive component.

It is usually very difficult to precisely control a luminosity and emission colour of light-emitting diode chips via various batches of a production in light-emitting diode technology. Thus, light-emitting diode chips from different batches typically have slightly different electrical characteristics and also differ from each other with respect to emission intensity and emission colour. For this reason, a sorting usually ensues immediately after a production of light-emitting diode chips, for instance according to emission colour, also designated as binning. The relatively large variation width of the optical characteristics of light-emitting diode chips makes it difficult to generate constant products with respect to intensity, emission colour and/or emitted colour temperature.

In lamps with light-emitting diodes as light sources, containing integrated control circuits, it is possible to measure and calibrate operating currents and required mixing ratios of light-emitting diode chips in groups with semiconductor light sources emitting various colours during production. However, this is not possible if a separate control unit exists that does not form an integral component of the lamp. In such case, a calibration is not easily achievable, as the lamp, relative to the control unit, can be replaced. A default setting and calibration in the factory is thus not possible, as such a calibration would have to be implemented manually when mounting the lamp and connecting to the control unit, which would involve a great deal of work. In particular for cost reasons it is usually not possible to provide each lamp with its own control unit either.

The lamp described herein comprises a terminal node, in which operating data for the associated lamp are stored and/or which provides control signals. Said terminal node can thus be essentially a memory, in particular not an electrically-active component. Such memories can be integrated in a lamp in a very cost-efficient and space-saving manner. Such memories can also be connected with sensors efficiently and with very little effort. The control unit can then read out the operating data from the terminal node and correspondingly activate the semiconductor light sources and the groups, thus ensuring that the desired intensities and colours are emitted. By this, it can be ensured that a similar optical performance and similar optical characteristics are achieved, irrespective of which precise lamp is connected to the control unit and independently of any calibration of the control unit and/or of the overall lighting system.

It is also possible that the terminal node is an active component like an integrated circuit that might provide the associated lamp with control signals. For example, the control unit provides the terminal node with data how the associated lamp has to be operated in sense of brightness and/or intensity. These data can then be used by the termainal node to elaborate and to send the control signals which can correspond to current and voltage values.

According to at least one embodiment, the connection line is mechanically flexible. Furthermore, the connection line can be relatively long, for example at least 1 m or 5 m or 10 m. This ensures that the semiconductor light sources or the groups are able to move relative to the terminal node when the lamp is used for its intended purpose or in a provided assembly of the lamp.

According to at least one embodiment, the terminal node comprises at least one sensor for temperature, humidity, ambient luminosity, operating current, light colour, luminosity, operating voltage, operating life and/or position in the room. The sensor can be firmly integrated inside the terminal node or fitted to an exterior of the terminal node. Alternatively, the sensor can be a separate component, independent of the terminal node. Data on the operating situation of the lamp are determinable via the one or more sensors, for example an ambient temperature or lighting conditions on the lamp. For instance a drop in performance over the service life can be compensated via the operating current of the lamp. With respect to the position in the room, it is possible to receive data on the absolute position via the sensor, for instance via GPS, or also data on a relative position, for example relative to a mobile station. Furthermore, the sensor can supply data on how the position of the lamp is relative to the direction of gravity.

According to at least one embodiment, the lamp also comprises one or more electrical terminal connections. The at least one terminal connection is electrically connected to the terminal node. It is possible to contact the lamp externally electrically via the terminal connection. The terminal connection is, for instance, a composite cable or also rigid conductive tracks, which run between a plug of the lamp and the terminal node. The terminal connection is preferably wired, but may also be configured to be wireless.

According to at least one embodiment, the terminal node is located between the terminal connection and the connection line. In such case, it is possible that no direct electrical connection between the terminal connection and the connection line exists. The terminal connection and the connection line can accordingly be electrically uncoupled.

According to at least one embodiment, the terminal connection and the connection line are partially or fully in direct electrical contact with each other. The terminal connection and the connection line can then also be a continuous line. For example, the connection line is then a continuation of a part of the wires of the terminal connection. Further, also exclusive, wires of the terminal connection can run to the terminal node, which can be electrically separated from the semiconductor light sources. This renders it possible that no direct electrical connection between the terminal node and the connection line and/or the semiconductor light sources exists.

According to at least one embodiment, the terminal connection is set up for bidirectional data transmission. Thus, the terminal connection allows a communication between the terminal node and/or the semiconductor light sources on the one hand and the control unit on the other hand via the terminal connection.

According to at least one embodiment, the connection line is merely set up for unidirectional data transmission and/or current transmission. In other words, no data flow is then provided from the semiconductor light sources or groups to the terminal node and/or the control unit.

According to at least one embodiment, the operating data of the semiconductor light sources and the groups are permanently stored in the terminal node, meaning that the operating data in the terminal node are not changed when the lamp is used according to its intended purpose, in particular not overwritten and/or re-determined.

According to at least one embodiment, the operating data comprise one or more of the following data types: current-luminosity curves, voltage-luminosity curves, operating time-luminosity curves, temperature-luminosity curves, current-colour location curves, voltage-colour location curves, temperature-colour location curves, operating time-colour location curves. In other words, the operating data are formed in particular by opto-electrical characteristics. A correction of the opto-electrical characteristic regarding operating time, ambient temperature and/or ambient luminosity based on the stored operating data is also possible.

According to at least one embodiment, the lamp comprises precisely one terminal node, precisely one terminal connection and a multiplicity of the semiconductor light sources or of the groups. For example, at least 3 or 10 or 25 and/or a maximum of 1000 or 300 or 100 or 30 of the semiconductor light sources exist.

According to at least one embodiment, the semiconductor light sources or groups of semiconductor light sources are arranged in serial along the preferably precisely one connection line, meaning that the connection line can be unbranched.

According to at least one embodiment, the connection line is electrically looped by the semiconductor light sources or groups of semiconductor light sources. For example, the semiconductor light sources and/or the groups are then electrically connected in series or electrically connected in parallel.

According to at least one embodiment, the semiconductor light sources comprise an identification unit or are directly coupled with an identification unit. Said identification unit is, for example, a memory unit, in which an electronic address of the semiconductor light sources or of the groups is saved. The semiconductor light sources or groups can be uniquely activated and/or addressed via the identification unit. The control signal provided for the respective semiconductor light source or group may be selected and/or filtered out by the identification unit and supplied to the associated semiconductor light source or group.

According to at least one embodiment, the semiconductor light sources are each connected to a current source. Supply lines to the current source may run parallel to the connection line and/or to the terminal connection. For example, a data flow of control signals to the semiconductor light sources ensues via the connection line and a connection to the current source is established via separate cable and/or wires. The semiconductor light sources are then supplied with current based on the control signal. Semiconductor light sources or groups can contain a corresponding control unit, for example an integrated circuit, to this end. The control unit and the identification unit can be configured in one piece.

According to at least one embodiment, the terminal node comprises or consists at least one of a read-only memory and at least one sensor. The term "consists of" does not exclude the possibility of passive components, such as mechanical supports or electrical connection lines or protective layers against external environmental influences being present. In particular the term "consists of" relates merely to components that are essential for the described function on hand.

A read-only memory is also designated as ROM ("Nur-Lese-Speicher" in German). The read-only memory is, for example, a mask ROM, which is only programmable at the time of release, a Programmable Read-Only Memory (PROM), which can be programmed only once, an Erasable Programmable Read-Only Memory (EPROM), deletable via UV light, or an Electrically Erasable Programmable Read-Only Memory (EEPROM).

According to at least one embodiment, the terminal node is set up to be read out from an external control unit, which does not belong to the lamp itself. The semiconductor light sources or groups are also set up to be activated with the control unit on the basis of the operating data saved in the terminal node. In other words, the lamp is set up in such a way that an operating current and/or an operating voltage and/or control signals for a driving method, such as pulse width modulation (PWM) can be adapted by the control unit based on the operating data, and therefore the desired luminosities and colours are generated by the lamp.

According to at least one embodiment, the terminal node comprises or consists of at least one of a microprocessor, an integrated circuit (IC), an application-specific integrated circuit (ASIC), a complex programmable logic device (CPLD), a field-programmable gate array (FPGA), an application-specific instruction set processor (ASIP), an arithmetic logic unit (ALU), and a floating-point unit (FPU).

In this case, the terminal node preferably can receive control data for the semiconductor light sources from the external control unit and can elaborate and adapt control signals and/or current signals for the semiconductor light sources so that the semiconductor light sources emit the desired illumination pattern. Thus, the terminal node might be able to translate the more abstract control data to precise control signals in particular taking into account the operating data saved in the terminal node.

In addition, a lighting system is provided. Said lighting system comprises one or more lamps, as indicated in connection with the above exemplary embodiments. Features of the lamp are thus disclosed for the lighting system and vice versa.

In at least one embodiment, the lighting system comprises a lamp as well as a control unit. The lamp is electrically connected to the control unit. In addition, the control unit is set up in such a way that the semiconductor light sources or the groups of semiconductor light sources are to be supplied with current and/or with control signals and activated varyingly in time.

According to at least one embodiment, image sequences, various lighting scenarios, video sequences and/or films are playable and/or displayable with the lighting system. For this purpose, the lighting system preferably comprises a plurality of lamps.

According to at least one embodiment, the lighting system serves to illuminate architecture. For example, the lighting system is partially or completely fitted to an external façade and/or in interior rooms of a building.

According to at least one embodiment, the control unit is adapted to receive lighting control signals from an external regulating unit. Said external regulating unit does not, however, form a component of the lighting system. The lighting control signals can, for instance, be DMX signals and/or RDM signals.

According to at least one embodiment, the control unit is only indirectly electrically connected with the semiconductor light sources or groups of semiconductor light sources via the terminal node. In other words, the terminal node can be electrically connected between the semiconductor light sources and groups like the control unit. Alternatively, the control unit can be directly electrically connected with all or with some of the semiconductor light sources or groups. In the latter case, for example, a direct electrical connection between the semiconductor light sources and the control unit exists via the terminal connection and the connection line.

Furthermore, an operating method for operating a lighting system is provided, as described in connection with the above embodiments. Features of the lamp and of the lighting system are thus also disclosed for the operating method and vice versa.

In at least one embodiment the operating method comprises at least the following steps, for example in the specified sequence:

Providing at least one of the lamps,

Electrical-photometric measuring and/or calibrating the at least one lamp and determining as well as storing the electrical operating data of the semiconductor light sources or groups of semiconductor light sources in the electrical terminal node, connecting of the at least one lamp to the control unit, and operating of the at least one lamp by means of the control unit.

An alternative possibility is that not the lamps themselves are measured and/or calibrated, but that the semiconductor light sources or the groups are measured, calibrated and/or pre-sorted and correspondingly put together with the lamp. In such case, the measuring can and/or the calibration must then be upstream and ensue before the step of providing the at least one lamp.

According to at least one embodiment, the step of measuring the at least one lamp and the step of determining as well as storing the operating data occurs only once. Such step is particularly preferably implemented before the first connection and operation of the at least one lamp on the later control unit. In other words, a unique default setting of the operating data in the terminal node ensues in the factory. The operating data in the terminal node are preferably not subjected to any further modification thereafter.

In at least one embodiment, the control unit reads out the operating data of the associated lamp once after first being plugged in, every time it is plugged in or repeatedly or constantly from the relevant terminal node and the semiconductor light sources or groups of semiconductor light sources are activated by the control unit on the basis of the operating data saved in the terminal node. Operating voltages and/or operating currents and/or control signals of the semiconductor light sources or of the groups of semiconductor light sources are in particular adapted based on the operating data saved in the terminal node, and therefore the associated lamp is operated in a manner defined with respect to a light intensity and/or a colour location. The adaption of the operating voltages and/or operating currents and/or control signals can occur in the control unit or in the terminal node itself, in particular if the terminal node itself sends the adapted control signals to the semiconductor light sources or groups of semiconductor light sources.

The following explains a lamp, a lighting system and an operating method described here in more detail, taking into account the drawing on the basis of exemplary embodiments. Identical reference numerals specify identical elements in the individual illustrations. Unless otherwise specified, no scales references are illustrated; instead individual elements can be illustrated in exaggeratedly large format in order to facilitate understanding.

Figure 2:
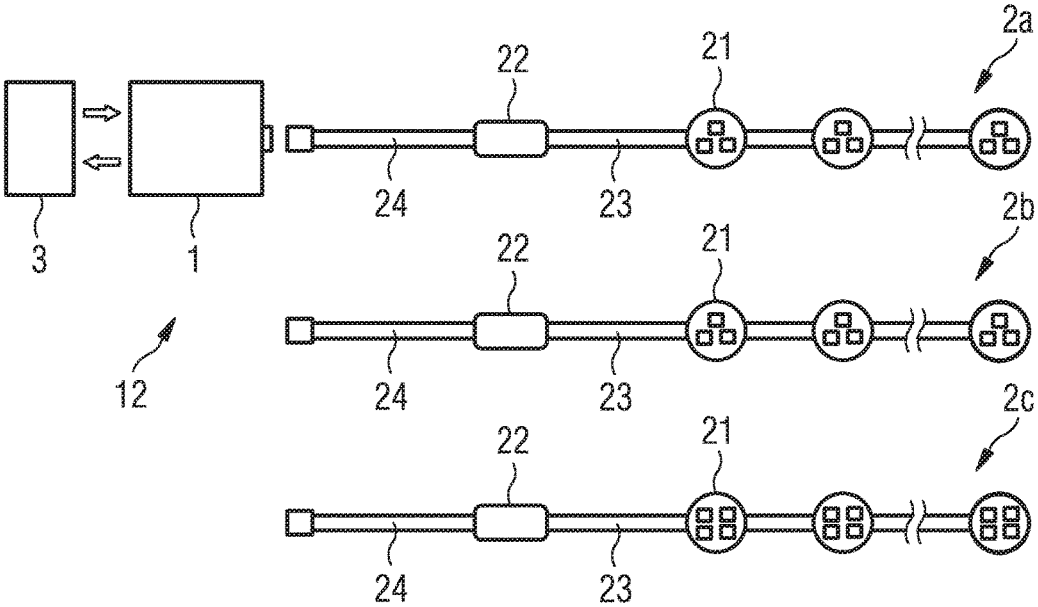
Figure 3:
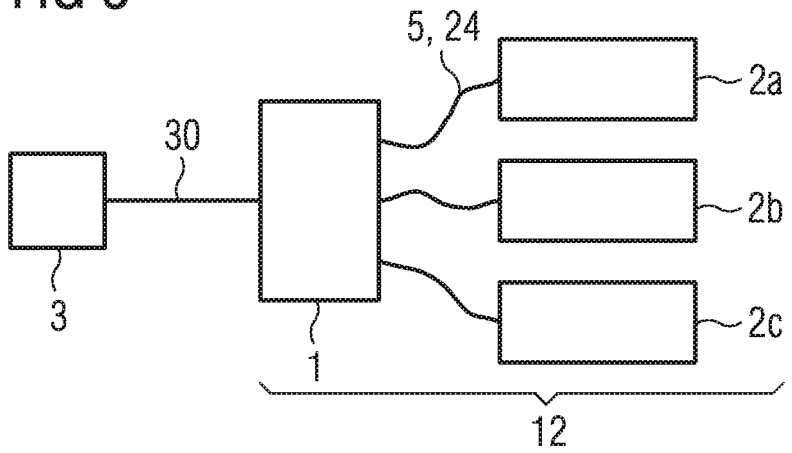
Figure 4:
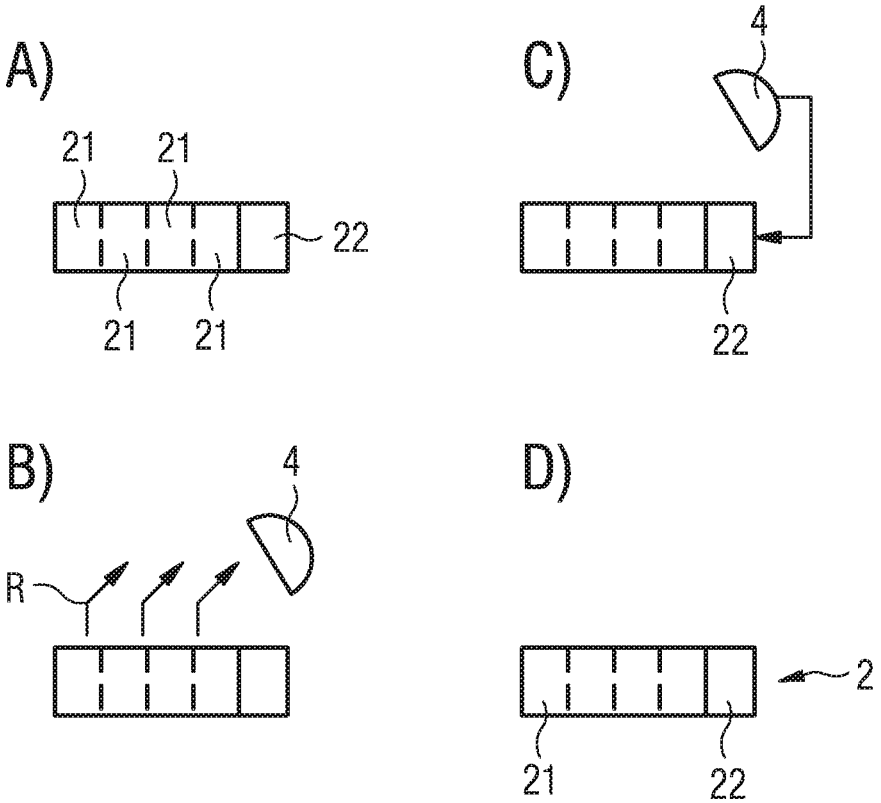

The figures show in:

FIGS. 1 to 3 schematic diagrams of embodiments of lighting systems described here with lamps described here, and FIG. 4 schematic procedural steps for producing a lamp described here for a lighting system described here.

FIG. 1 schematically illustrates an exemplary embodiment of a lighting system 12. The lighting system 12 comprises a lamp 2 as well as a control unit 1. The lamp 2 is electrically connected to the control unit 1 via a connecting element 5 that is preferably reversible operable, in particular without tools. The connecting element 5 concerned is in particular a bushing and an associated plug.

The lamp 2 comprises a plurality of semiconductor light sources 21. Said semiconductor light sources 21 are preferably light-emitting diodes. The semiconductor light sources 21 can each comprise an identification unit, and therefore the semiconductor light sources 21 can be electrically activated independently of each other.

The semiconductor light sources 21 are connected with an electrical terminal node 22 via an electrical connection line 23. Operating data of the semiconductor light sources 21 are saved in the terminal node 22. Saved in particular in the terminal node 22 is which types of semiconductor light sources 21 are concerned, which kinds of semiconductor light sources 21 and how many semiconductor light sources 21 exist in combination with each other in the lamp 2. Alternatively or additionally, characteristics for operating the semiconductor light sources 21 can be saved, in tabular form in the terminal node 22 for instance. The terminal node 22 can be an electrically passive component or an electrically active component like a microprocessor.

Optionally one or more sensors 25 are integrated in the terminal node 22. Said sensor 25 measures, for example, a temperature, an ambient luminosity, a luminosity and/or emission colour emitted by the lamp itself or also an operating life. A plurality of sensors 25 for various measured variables can be combined with each other.

The terminal node 22 is permanently connected with the connecting element 5 via an electrical terminal connection 24. It is possible that an electrical connection between the terminal connection 24 and the connection line 23 is interrupted by the terminal node 22. Alternatively, at least some of the electrical lines can extend uninterruptedly over the terminal connection 24 and the connection line 23.

The connection line 23 is preferably set up for unidirectional communication between the semiconductor light sources 21 as well as the terminal node 22 and/or the control unit 1. Conversely, bidirectional communication between the terminal node 22 and the control unit 21 ensues via the terminal connection 24.

The lighting system 12 preferably receives lighting control signals 33 via an external regulating unit 3, which need not be part of the lighting system 12. The external regulating unit 3 is, for example, a computer.

Lighting control signals 33 are, for example, DMX signals or RDM signals. Furthermore, it is possible that control signals 34 are transmitted by the control unit 1 of the external regulating unit 3. The control signals 34 contain, for example, information on an operating status, for instance, a current consumption or a temperature of the lighting system 12.

FIG. 2 schematically illustrates an operating method for the lighting system 12. Different lamps 2*a*, 2*b*, 2*c* are connected to the control unit 1 in temporal succession, alternating or temporally parallel in relation to each other. The lamps 2*a*, 2*b*, 2*c* can have different spectral emission properties and/or various electrical characteristics. The required operating data of the control unit 1 for the correct activation of the respective lamp 2*a*, 2*b*, 2*c* are provided by the terminal node 22, which is firmly connected with the semiconductor light sources 21, and therefore the control unit 1 can emit correspondingly adapted control signals to the semiconductor light sources 21.

According to FIG. 2, the semiconductor light sources 21 are merged into groups, wherein each of the groups can form an image point, also designated as pixel. Each of the groups comprises, for example, a light-emitting diode for red light, one for green light and one for blue light, thus forming an RGB unit. For instance, information can be saved in the terminal node 22 in this constellation that the light-emitting diode emission for green light is comparatively weaker for specific groups. This information, saved in the operating data in the terminal node 22, allows the control unit 1 or the terminal node 22 itself to adapt the control signal for this relevant light-emitting diode that such light-emitting diode is operated with a higher current and generates the required luminosity.

FIG. 3 shows a further exemplary embodiment of the lighting systems 12. A plurality of lamps 2*a*, 2*b*, 2*c* are simultaneously connected to the control unit 1. This allows the lamps 2*a*, 2*b*, 2*c* to be nominally identical or also specifically differently designed. The information required for activation can be read out from the terminal node 22, thus ensuring a correct activation via the control unit 1 or via the terminal node 22 itself as well as via the external regulating unit 3 connected with a data line 30. The data line 30 can be wired or wireless in design.

FIG. 4 illustrates a production method for such lamps 2. Such production method can be interpreted as part of the operating method for an associated lighting system 12 or as a separate method.

FIG. 4A shows the provision of the terminal node 22 as well as the associated semiconductor light sources 21. The configuration of the semiconductor light sources 21 is determined by this method step.

In FIG. 4B the semiconductor light sources 21 are operated, such that the light R is emitted. Said light R is at least partially received and analysed by a detector 4.

As shown in FIG. 4C, the operating data for the lamp 2 are determined from the analysis of the light R and saved, preferably permanently and invariably, in the terminal node 22.

The completed lamp 2 is ultimately schematically shown with the saved operating data in FIG. 4D.

The invention described here is not limited by the description based on the exemplary embodiments. Instead, the invention comprises every new feature as well as every combination of features, which in particular includes every combination of features in the claims, even if such feature or such combination is not explicitly provided itself in the claims or exemplary embodiments.

LIST OF REFERENCE NUMERALS

12 Lighting system
1 Control unit

2 Lamp
21 Semiconductor light source
22 Electrical terminal node
23 Electrical connection line
24 Electrical terminal connection
25 Sensor
3 External regulating unit
30 Data line
33 Lighting control signal
34 Control signal
4 Detector
5 Connecting element/plug
R Light

The invention claimed is:

1. A lamp comprising:
a plurality of semiconductor light sources or groups of semiconductor light sources,
an electrical terminal node, and
at least one electrical connection line, wherein
the semiconductor light sources are electrically connected with the terminal node via the at least one connection line,
electrical operating data of the semiconductor light sources or of the groups of semiconductor light sources are saved in the terminal node,
the semiconductor light sources or the groups of semiconductor light sources of the lamp can be electrically activated independently of each other, and
the terminal node is an electrically passive or active component, and the electrical operating data of the semiconductor light sources or of the groups of semiconductor light sources are permanently saved in the terminal node and the operating data comprise one or more of the following data types: current-luminosity curves, voltage-luminosity curves, operating time-luminosity curves, temperature-luminosity curves, current-color location curves, voltage-color location curves, temperature-color location curves, operating time-color location curves.

2. The lamp according to claim 1, in which the semiconductor light sources or groups of semiconductor light sources are set up to emit temporally changeable varied coloured lights, wherein the connection line is mechanically flexible, and therefore the semiconductor light sources or groups of semiconductor light sources can be moved relative to the terminal node when used for the intended purpose.

3. The lamp according to claim 1, in which the terminal node comprises at least one sensor for temperature, humidity, ambient luminosity, operating current, operating voltage, operating time and position in the room.

4. The lamp according to claim 1, further comprising an electrical terminal connection, which is connected with the terminal node, wherein the lamp is set up to be externally electrically connected via the terminal connection.

5. The lamp according to claim 4, in which the terminal node is located between the terminal connection and the connection line.

6. The lamp according to claim 4, in which no direct electrical connection exists between the terminal connection and the connection line.

7. The lamp according to claim 4, in which the terminal connection is capable of bidirectional data transmission and the connection line only for unidirectional data transmission or current transmission.

8. The lamp according to claim 1, comprising precisely one terminal node, precisely one terminal connection and between three and 300 of the semiconductor light sources or the groups of semiconductor light sources inclusively, wherein the semiconductor light sources or groups of semiconductor light sources are arranged in serial along the precisely one connection line and the connection line is electrically looped through by the semiconductor light sources or groups of semiconductor light sources.

9. The lamp according to claim 1, in which the terminal node consists of a read-only memory or of a read-only memory together with a sensor or of a read-only memory together with a sensor and together with a microprocessor or of a read-only memory together with a microprocessor.

10. The lamp according to claim 1, in which the terminal node is set up to be read out by an external control unit, wherein the semiconductor light sources or the groups of semiconductor light sources are set up to be activated with the control unit or with the terminal node on the basis of the operating data saved in the terminal node.

11. A lighting system comprising:
at least one lamp according to claim 1, and
a control unit,
wherein the lamp is electrically connected to the control unit and said control unit is set up to supply the semiconductor light sources or the groups of semiconductor light sources with at least one of current and control signals and activate them varyingly in time.

12. The lighting system according to claim 11, with which image sequences, various lighting scenarios, video sequences or films are playable, wherein the lighting system comprises a multiplicity of the lamps.

13. The lighting system according to claim 11, in which the control unit is set up to receive lighting control signals from an external regulating unit, wherein the lighting control signals concerned are DMX signals or RDM signals.

14. The lighting system according to claim 11, in which the control unit is only indirectly electrically connected with the semiconductor light sources or groups of semiconductor light sources via the terminal node.

15. The lighting system according to claim 11, in which the control unit is directly electrically connected with all or with some of the semiconductor light sources or groups of semiconductor light sources.

16. An operating method for operating a lighting system according to claim 11, comprising the following steps in the specified sequence:
providing a variety of the lamps,
electrical-photometric measuring and calibrating the lamps and determining as well as saving the electrical operating data of the semiconductor light sources or groups of semiconductor light sources in the electrical terminal node,
connecting of the lamps to the control unit, and
operating of the lamps by means of at least one of the control unit and the terminal node based on the operating date, wherein the step of measuring and of determining as well as storing the operating data occurs only once, and is done before the first connection and operation of the lamps, so that a unique default setting of the operating data in the terminal node is factory-made, and wherein the lamps comprise differing operating data.

17. The operating method according to claim 16,
wherein the control unit reads out the operating data of the associated lamp from the relevant terminal node and the semiconductor light sources or the groups of semiconductor light sources are activated by the control unit or by the terminal node on the basis of the operating data saved in the terminal node, wherein at least one of operating voltages and operating currents of the semiconductor light sources or of the groups of semiconductor light sources are adapted based on the operating data saved in the terminal node, and therefore the associated lamp is operated in a defined manner with respect to at least one of light intensity and colour location.

* * * * *